US005277920A

United States Patent [19]

Weaver, Jr.

[11] Patent Number: 5,277,920

[45] Date of Patent: Jan. 11, 1994

[54] PACKAGING FOR FOOD PRODUCTS

[75] Inventor: Edmund A. Weaver, Jr., Racine, Wis.

[73] Assignee: Kraft General Foods, Inc., Northfield, Ill.

[21] Appl. No.: 815,112

[22] Filed: Dec. 27, 1991

[51] Int. Cl.[5] ..... B65D 75/60

[52] U.S. Cl. ..... 426/115; 426/120; 426/122; 206/469; 222/103; 222/107; 222/541

[58] Field of Search ..... 426/120, 115, 122; 206/469; 222/541, 107, 103

[56] References Cited

U.S. PATENT DOCUMENTS

| | | | |
|---|---|---|---|
| 3,477,614 | 11/1969 | Runge | 222/107 |
| 3,520,439 | 7/1970 | Smith et al. | 220/23.4 |
| 3,743,520 | 7/1973 | Croner | 426/120 |
| 4,339,033 | 7/1982 | Cillario | 206/216 |
| 4,430,013 | 2/1984 | Kaufman | 401/132 |
| 4,449,350 | 5/1984 | Sanford | 53/412 |
| 4,493,574 | 1/1985 | Redmond et al. | 401/132 |
| 4,611,715 | 9/1986 | Redmond | 206/484 |
| 4,648,506 | 3/1987 | Campbell | 206/216 |
| 4,700,532 | 10/1987 | Redmond | 53/452 |
| 4,724,982 | 2/1988 | Redmond | 206/469 |
| 4,790,429 | 12/1988 | Fukushima | 206/469 |
| 4,819,406 | 4/1989 | Redmond | 53/51 |
| 4,903,842 | 2/1990 | Tokuda | 206/469 |
| 4,966,296 | 10/1990 | Farrell | 220/23.4 |
| 5,052,553 | 10/1991 | De Sanctis | 426/115 |

FOREIGN PATENT DOCUMENTS

| | | | |
|---|---|---|---|
| 0420429 | 3/1991 | European Pat. Off. | 426/120 |
| 2728940 | 1/1979 | Fed. Rep. of Germany | 426/120 |
| 3324462 | 1/1985 | Fed. Rep. of Germany | 426/120 |
| 2242890 | 10/1991 | United Kingdom | 426/115 |

*Primary Examiner*—Carolyn Paden

*Attorney, Agent, or Firm*—Fitch, Even, Tabin & Flannery

[57] ABSTRACT

Disclosed is packaging which includes two separate compartments, a first compartment for storing a flowable product such as cheese spread, and a second compartment for storing a solid product such as crackers. The first compartment, housing the flowable product, includes a lid having a scored portion which is broken upon bending of the packaging along a longitudinal bending region. To prevent unintentional discharge of the flowable product prior to its intended use, such as during shipping or other handling in which the flowable compartment may inadvertently be bent in the longitudinal direction, and thereby rupture the lid at the score line with the flowable product being dispensed therethrough, the flowable product compartment is separably attached to the solid product compartment along a side of the flowable compartment perpendicular to the longitudinal bendable region to increase its rigidity to bending in the longitudinal direction. A flexible polymeric film may be peelably sealed over the lid of the first compartment to restrict disbursement of product in the event of a premature rupture of the second portion of the lid, and to maintain the lid free of the scored portion of the lid, and to maintain the lid free of contaminants during shipping and handling.

16 Claims, 2 Drawing Sheets

PACKAGING FOR FOOD PRODUCTS

FIELD OF THE INVENTION

This invention relates to disposable food packaging, and more particularly, relates to a container having more than one compartment.

BACKGROUND OF THE INVENTION

Disposable food packaging which allows consumers to transport, open and eat a food product at any desired location and then readily dispose of the food packaging have risen in popularity in recent years. More particularly, there has been a demand for such disposable packaging which provides a soft or flowable food product together with another, solid food product on which the flowable food product is to be applied prior to consumption.

For instance, currently cheese and cracker packaging is popular, wherein a polymeric material such as PVC is thermoformed to form a two compartment package for storing a cheese product in a first compartment and crackers in the second compartment. A thin film of flexible thermoplastic material extends over the top of the packaging and forms a hermetic peelable seal to maintain freshness of the food stored in the packaging. A flat spreading implement is inserted into the second compartment after insertion of the crackers and prior to its being sealed with the plastic film. The spreading implement serves as a knife whereby, after the peelable film is removed, the cheese product is scooped out of the first compartment and spread over the crackers.

There is considerable expense associated with the provision of equipment for inserting a spreading implement into each package. Also, difficulty has been encountered in properly inserting the spreading implements into the packaging. It is desirable that the spreading implement be placed atop the stack of crackers. However, in some cases, the spreading implements tend to fall to one side of the stack, which makes access to the implement more difficult for the consumer, and is therefore unacceptable. The necessity to maintain quality control with respect to inclusion of the spreading implements and proper placement thereof can result in costly production interruptions to adjust the insertion equipment.

SUMMARY OF THE INVENTION

In accordance with the present invention, packaging is provided which includes two separate compartments, a first compartment for storing a flowable food product such as cheese spread, and a second compartment for storing a solid food product such as crackers or bread sticks. The first compartment, housing the flowable food product, includes a lid having a weakened portion such as a score line which is broken upon bending of the packaging along an elongated bendable region.

To prevent unintentional discharge of the flowable food product prior to its intended use, such as during shipping or other handling in which the flowable food compartment may inadvertently be bent and thereby rupture the lid at the score line, with the flowable food product being dispensed therethrough, means are provided to prevent bending of the first compartment along the elongated bendable region. To this end, the flowable food compartment is separably attached to the solid food compartment along a side of the flowable food compartment which is perpendicular to the elongated bendable region. By so attaching the food compartments a significantly increased resistance to bending of the flowable food product compartment is attained.

Upon separation of the flowable food compartment from the adjoining second, solid food compartment, the additional structural support provided by the solid food compartment is removed and the flowable food compartment is then easily bendable to break open at the weakened portion and allow dispensing of the flowable food product therefrom. Accordingly, a flowable food product such as cheese spread can be dispensed onto another food product such as bread sticks or crackers without assistance from additional tools such as a spreading implement, as previously required. Furthermore, this packaging lends itself to inexpensive, large scale production.

The lid of the second compartment may have a cover attached thereto by a peelable seal to restrict disbursement of flowable product in the event of inadvertent rupture of the lid, and to maintain the upper lid surface free from contaminants.

DETAILED DESCRIPTION OF THE PREFERRED EMBODIMENTS

Figure 1:
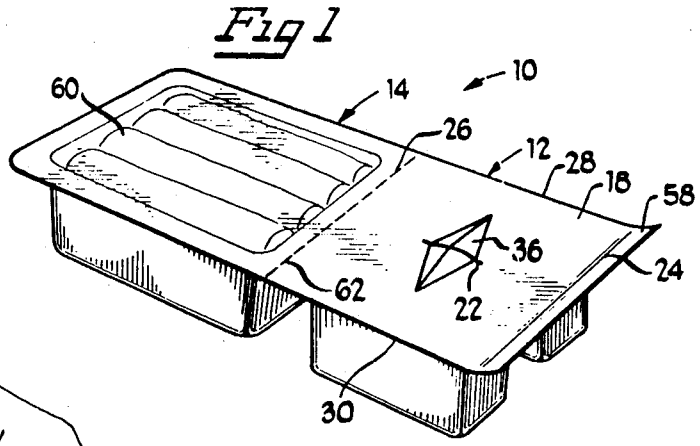
FIG. 1 is a perspective view of packaging embodying various features of the present invention, in which the flowable and solid food compartments are attached.
Figure 2:
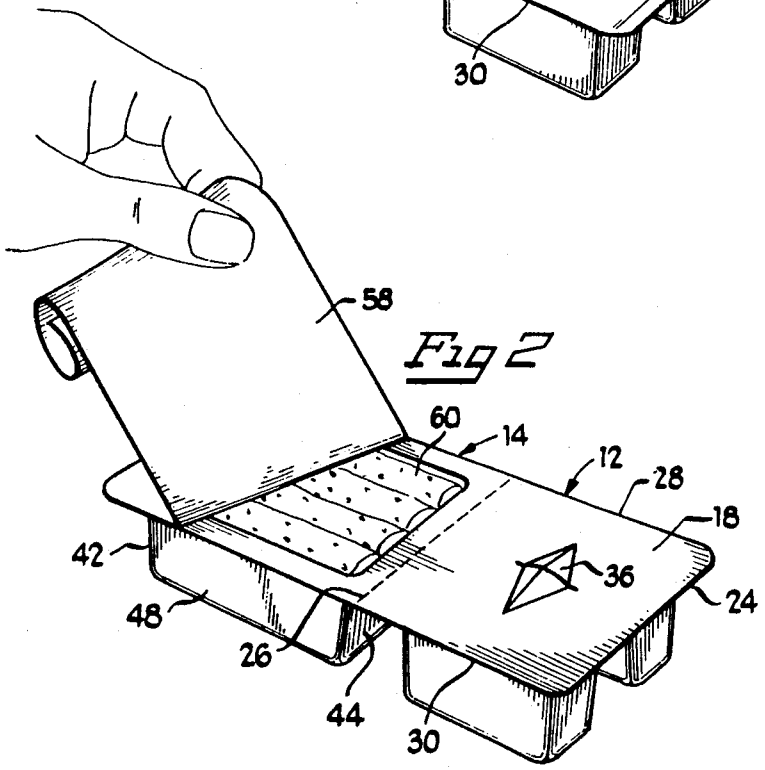
FIG. 2 is a perspective view of the packaging of FIG. 1, shown with a sealing member being removed from the packaging.

Packaging embodying various features of the present invention is illustrated in FIGS. 1-6 and referred to generally by the reference numeral 10. The packaging includes a flowable food product compartment, indicated generally at 12, and a solid food compartment, indicated generally at 14. Initially, the flowable food compartment 12 and solid food compartment 14 are interconnected, by an interconnection which is designed to allow separation of the two food compartments at the desired time of consumption. The interconnection prevents the flowable food compartment 12 from opening and dispensing flowable food product 20 therefrom until the flowable food compartment 12 is detached from the solid food compartment 14, but allows dispensing of the flowable food product 20 following detachment, as explained below.

The flowable food compartment 12 comprises a cup 16 of flexible plastic material. The upper, open end of the cup 16 is sealed by a generally flat lid or wall 18 to maintain freshness of the flowable food product 20 therein (see FIG. 4). The flowable food compartment 12 defines opposite transverse sides 24 and 26 as well as front and rear longitudinal sides 28 and 30, respectively. The lid 18 includes a short score line 22 formed therein which extends longitudinally, generally parallel to the longitudinal sides 28 and 30 approximately midway therebetween. The score line 22 preferably bisects a generally pyramidal stress concentrator 36 and the lid 18 ruptures thereat upon sufficient bending of the lid 18 by displacement of the longitudinal edges 28 and 30 downward relative to the stress concentrator 36 so as to bend the lid along an elongated longitudinal bending region 62 thereby effecting tensile loading across the stress concentrator in a transverse direction as indicated at 32. The stress concentrator may be of the type disclosed in U.S. Pat. No. 4,819,406, which is defined by four triangular surfaces sloping upward from the surrounding area of the lid 18 to an apex 68 and having a transverse dimension greater than its longitudinal dimension. The stress concentrator 36 is preferably symmetrical about the score line 22.

Figure 4:
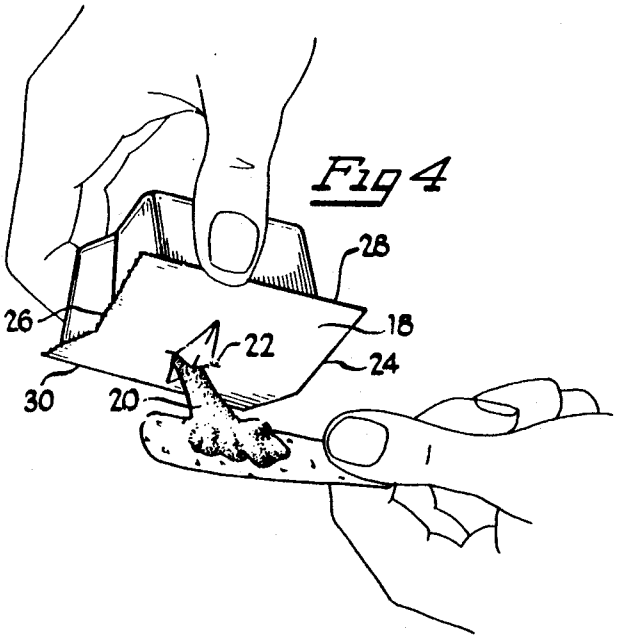
FIG. 4 is a perspective view of the flowable food product compartment, shown being bent to dispense the flowable food product therefrom.
Figure 5:
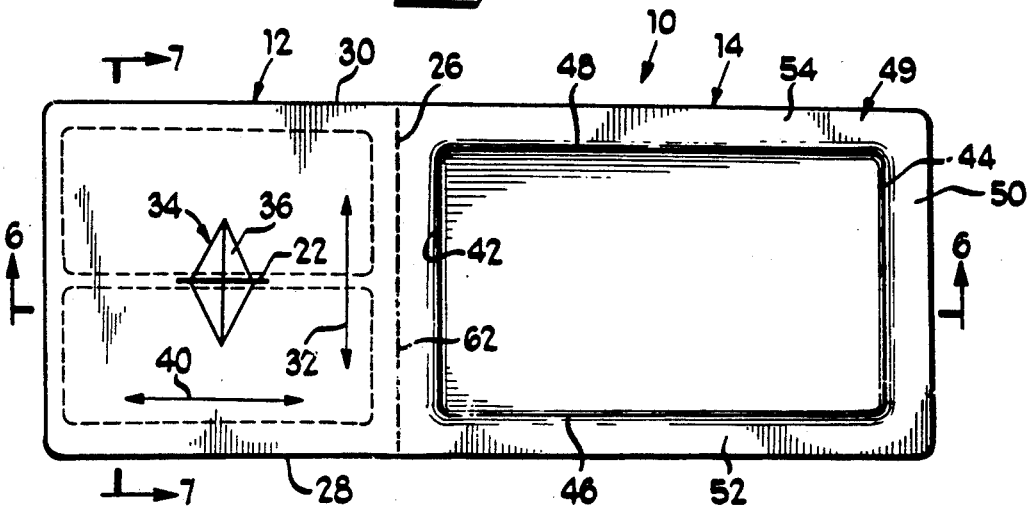
FIG. 5 is a plan view of the packaging of FIG. 1.

The rupture at the score line 22 provides an outlet for dispensing of the flowable food product 20 from the flowable food compartment 12, as illustrated in FIG. 4, which outlet is referred to generally as dispensing outlet 34. Upon further transverse bending, the cup 16 is squeezed to urge the flowable product 20 therein out of the hole in the ruptured lid.

Figure 7:
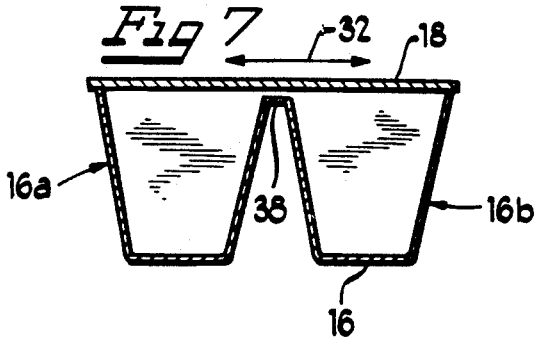
FIG. 7 is a sectional view taken substantially along line 7—7 of FIG. 5.

The flexible plastic cup 16 attached to the lid 18 is preferably formed into two sections 16*a* and 16*b* in communication with one another, as best illustrated in FIG. 7. The ridge 38 at the middle of the two cup sections 16*a* and 16*b* serves the dual purpose of both facilitating bending along the elongated longitudinal bending region 62 (see arrows 32), while providing resistance to bending in the opposite direction (see arrows 40 in FIG. 5). This aids in dispensing of the flowable product wherein the two cup sections 16*a* and 16*b* are pressed against one another, thereby expressing the flowable food product from both cup sections 16*a* and 16*b* through the dispensing outlet 34, as illustrated in FIG. 4.

To prevent the flowable food compartment 12 from being inadvertently bent along bending area 62 prior to the time of its intended use, the lid 18 of the flowable food compartment 12 is detachably connected to the solid food compartment 14 along a transverse side 26 of the flowable food compartment 12. The solid food compartment thus provides significant resistance to bending of the lid 18 in the transverse direction. The stiffness of the filled solid food compartment 14 is sufficient to prevent bending of the lid 18, and therefore unintentional discharge of flowable food product 20, in situations in which bending of the lid 18 and flowable food discharge would have otherwise occurred.

In the preferred embodiment, the solid food compartment 14 is generally rectangular and includes transverse sidewalls 42 and 44 as well as longitudinal sidewalls 46 and 48, respectively. At the upper end of each of the sidewalls is a continuous lip 49 which extends generally perpendicular to the sidewalls. The continuous lip 49 includes lip section 50 extending from the transverse sidewall 44, lip section 52 extending from the longitudinal sidewall 46, and lip section 54 extending from the longitudinal sidewall 48, each of which are generally short lips having only sufficient width to provide a sealing surface for sealing the solid food compartment 14 with a sheet of plastic 58 (see FIGS. 1 and 2). By adhering the plastic sheet or film 58 to the continuous lip 49, the solid food product stored in the solid food compartment 14, such as the bread sticks 60 illustrated in the drawings, is maintained fresh. The plastic film 58 may extend over the open upper end of the solid food compartment 14 alone, or may extend over both the solid food compartment 14 and the upper wall 18 of the flowable food compartment 12 to provide a cover therefor. A plastic film 58 hermetically sealed over both food compartments 12 and 14 allows the hermetic sealing of the flowable food product to be maintained even if the upper wall 18 were accidentally ruptured. The film 58 also serves to keep the dispensing outlet 34 clean.

In the preferred embodiment, the lip section 56 extending from lateral sidewall 42 is an extended lip section, and is significantly longer than the other lip sections 50, 52 and 54. Preferably, the length of the extended lip is between approximately 0.3 and 0.5 times the length of the solid food compartment 14. With particular reference to the cross-sectional view of FIG. 6, in the preferred embodiment of the invention this extended lip section 56 is integral with the lid 18 of the flowable food compartment 12.

Figure 6:
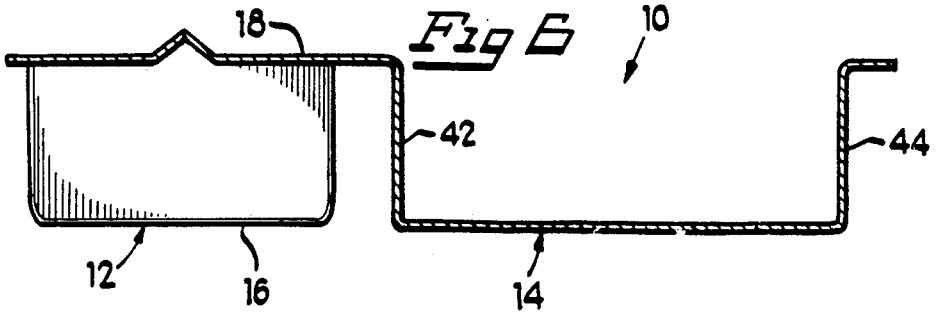
FIG. 6 is a sectional view of the packaging of taken along line 6—6 of FIG. 5.

Thus, in this embodiment a single, integral thermoformed plastic structure is formed which defines both the entire solid food compartment 14 and the lid 18 of the flowable food compartment 12, as best seen in FIG. 6. The dispensing outlet 34 is preferably also formed integral therewith. The structure 70 is preferably comprised of polyvinylchloride or other suitable material.

The cups 16*a* and 16*b* are also by a thermoforming operation in which a film of a suitable polymeric material is heated to a desired forming temperature with vacuum pressure thereafter pulling the film into a cooled female die to achieve the desired two cup formation. The thermoformed cups 16*a* and 16*b* are then filled with a predetermined quantity of flowable food product and the open end of the cups subsequently sealed to the lower surface of the wall 18 to enclose the flowable food product. Subsequently, the solid food product 60 may be added to the second compartment, and the film 58 may be laid on over the top of the container 10 and sealed in place about its periphery. The film 58 may be made of any suitable material such as polyester or polypropylene material having a heat seal layer thereon.

Figure 3:
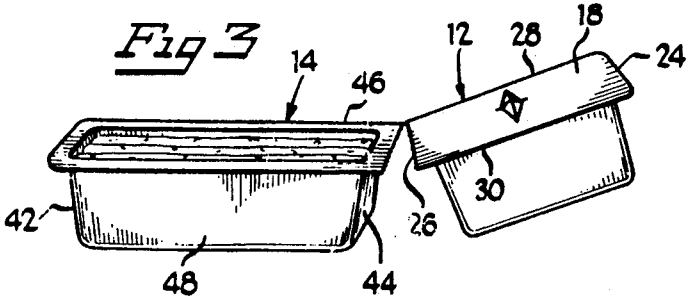
FIG. 3 is a perspective view of the packaging of FIG. 1, shown with the first and second food compartments being separated from one another.

A line of weakness 62 traverses the width of the extended lip 56 and extends between the flowable food compartment 12 and the solid food compartment 14. The line of weakness is preferably a perforated line 62 and provides for easy separation of the two food compartments 12 and 14 at the desired time of consumption, while maintaining interconnection of the two food compartments until they are intentionally separated. The perforated line 62 is preferably formed by a hot knife which is extended part-way into the wall 18 to weaken the wall thereat. By flexing the packaging 10 along the line of weakness 62, the strength of the interconnection is reduced sufficiently to allow the two food compartments 12 and 14 to be easily torn from one another at the line of weakness 62 as shown in FIG. 3.

The term flowable food product is meant to encompass any and all food products which can be deformed under applied pressure so as to be extruded from a storage compartment through a small opening.

Hence, packaging 10 is provided which stores a flowable food product 20, such as a cheese product, in a first compartment 12 and stores a solid food product 60, such as crackers or bread sticks, in a second compartment 14. The flowable food product 20 from the first compartment 12 is easily dispensed onto the solid food product 60 of the second compartment by simply bending the first compartment 12 to rupture the lid 18 at the score line 22, and thereafter squeezing out the flowable food product through the opening created. The packaging 10, however, includes means for preventing bending of the lid 18 of the first compartment 12 about the longitudinal bending area 62, and hence unintentional discharge of the flowable food product 20 from the first compartment 12, until the first and second compartments 12 and 14 have been separated from one another. Thus, during handling prior to use, none of the flowable food product 20 will be discharged from the flowable food compartment 12. Yet, subsequent to separation of the food compartments 12 and 14, dispensing of the flowable food product 20 from the flowable food compartment 12 is accomplished by simply bending it and pressing cup sections **16*a* and 16*b*** together, without the need of additional implements such as knives or the like.

While the invention has been described with reference to a preferred embodiment, it will be understood to those skilled in the art that various changes may be made and equivalents may be substituted for elements thereof without departing from the scope of the invention. In addition, many modifications may be made to adapt a particular situation or material to the teachings of the invention without departing from the essential scope thereof. For instance, the score line 22 may be formed after thermoforming or may be made at the time of the thermoforming operation. Also, other configurations of stress concentrators can be employed. Therefore, it is intended that the invention not be limited to the particular embodiment disclosed as the best mode contemplated for carrying out this invention, but that the invention will include all embodiments falling within the scope of the appended claims.

What is claimed is:

1. A package having a first compartment for storing a first, flowable product and second compartment for storing a second product, the package comprising:

said first compartment comprising;

an upper wall of flexible material having an elongated bendable region;

a cup of flexible material which is sealed by said upper wall to retain the flowable product therein; and said upper wall having a sealed dispensing outlet which may be broken open by bending said upper wall along said elongated bendable region to allow the flowable product therein to be dispensed through said dispensing outlet;

said first compartment having opposite transverse sides extending generally perpendicular to said elongated bendable region, and being connected to the second compartment along one of said transverse sides to provide structural support to the first compartment to prevent bending thereof along said elongated bendable region until after said first compartment is separated from said second compartment; and separating means to facilitate separation of said first compartment from said second compartment to remove the structural support provided to said first compartment by said second compartment, thereby permitting bending of said upper wall along said elongated bendable region to open said first compartment for dispensing of said flowable product from said first compartment.

2. A package in accordance with claim 1 wherein said dispensing outlet comprises a line of weakness in said upper wall which may be broken open upon bending of said upper wall along said elongated bendable region to allow the flowable product therein to be dispensed through the opening.

3. A package in accordance with claim 1 wherein said cup of flexible material comprises two compartments which define a ridge therebetween, said ridge extending beneath said elongated bendable region, the two portions being pivotable about said ridge so that they may be pressed against one another to bend the top wall along said elongated bendable region to break open said line of weakness and force the flowable product therefrom.

4. A package in accordance with claim 3 wherein said dispensing outlet comprises a raised portion in communication with both of said compartments having a line of weakness therein which may be broken open upon bending of the first compartment along said elongated bending region to allow dispensing of the flowable product of both cup portions through the common opening.

5. A package in accordance with claim 1 wherein the connection of said first and second compartments is a thin interface, the interface having a line of weakness to allow separation of the first and second compartments along said line of weakness.

6. A package in accordance with claim 1 wherein said dispensing outlet comprises a raised portion of predetermined contour.

7. Packaging in accordance with claim 1 wherein a film of thermoplastic material extends over both said first compartment and said second compartment.

8. Packaging in accordance with claim 7 wherein said thermoplastic film is hermetically sealed to said first compartment and said second compartment.

9. Packaging for storing two products, comprising:

an integral piece of semi-rigid plastic material molded to form a first receptacle for retaining a first product therein, the receptacle having a lip extending generally perpendicularly from the open end thereof, a portion of said lip being substantially extended in a longitudinal direction and having an upper surface and a lower surface, and having an elongated bendable region oriented in said longitudinal direction;

flexible plastic material defining a flexible second receptacle having an open end, for retaining a second product therein, the open end of the second receptacle being adhered to the lower surface of the extended lip portion to seal the second product in the second receptacle;

dispensing means formed in said extended lip portion which may be split open by bending of the extended lip portion at the elongated bendable region to provide an opening in said extended lip portion through which said second product may be dispensed from said second receptacle; and detaching means extending transversely across said extended lip portion for facilitating detachment of said extended lip portion from the remainder of said first receptacle to allow bending of the second receptacle at the elongated bendable region subsequent to separation.

10. Packaging in accordance with claim 9 wherein said dispensing means comprises a score line in the extended lip generally parallel to the elongated bendable region.

11. Packaging in accordance with claim 10 wherein said dispensing means further includes a raised portion in said extended lip of predetermined contour, in communication with the contents of the second receptacle and adjacent the score line formed in the extended lip, to accurately direct the discharge from the second receptacle.

12. Packaging in accordance with claim 9 wherein said flexible plastic material defining the second receptacle is molded to form two adjacent receptacle portions.

13. Packaging in accordance with claim 9 wherein said extended lip is between 0.3 and 0.5 times the length of the first receptacle.

14. Packaging in accordance with claim 9 wherein said second receptacle is made of a material suitable for storage of a cheese product therein.

15. Packaging in accordance with claim 9 wherein said detaching means comprises a line of weakness traversing said extended lip portion.

16. Packaging in accordance with claim 9 further including a sheet of plastic material covering said first receptacle and said upper surface of said extended lip.

* * * * *